US006587656B2

(12) United States Patent
Lee et al.

(10) Patent No.: US 6,587,656 B2
(45) Date of Patent: Jul. 1, 2003

(54) HEATING ROLLER ASSEMBLY FOR ELECTROPHOTOGRAPHIC PRINTER AND METHOD OF MAKING THE SAME

(75) Inventors: Kyung-Woo Lee, Suwon (KR); Durk-Hyun Cho, Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/978,632

(22) Filed: Oct. 18, 2001

(65) Prior Publication Data

US 2002/0114639 A1 Aug. 22, 2002

(30) Foreign Application Priority Data

Feb. 22, 2001 (KR) ..... 2001-9038

(51) Int. Cl.[7] ..... G03G 15/00

(52) U.S. Cl. ..... 399/90; 219/216; 399/330; 399/303

(58) Field of Search ..... 399/33, 37, 88, 399/90, 330, 333, 335; 219/216, 469, 470, 471

(56) References Cited

U.S. PATENT DOCUMENTS

| | | | | |
|---|---|---|---|---|
| 4,813,372 A | * | 3/1989 | Kogure et al. | 219/216 X |
| 4,888,464 A | * | 12/1989 | Shibata et al. | 219/216 |
| 5,065,193 A | * | 11/1991 | Saitoh et al. | 219/216 X |
| 6,091,051 A | * | 7/2000 | Morigami et al. | 219/216 |
| 6,252,199 B1 | * | 6/2001 | Toyota et al. | 219/216 |

* cited by examiner

*Primary Examiner*—Hoan Tran
(74) *Attorney, Agent, or Firm*—Robert E. Bushnell, Esq.

(57) ABSTRACT

A direct heating type heating roller assembly for an electrophotographic printer such as a laser printer, a copier or the like, is provided to press and heat a printing medium. The heating roller assembly include a cylindrical roller body and a power connecting members each coupled to both ends of the roller body to apply electric power to a heating layer which is disposed between the roller body and a protective layer. The power connecting member has one or more stepped surface or an inclined surface corresponding to the stepped structure of heating layer and the protective layer.

23 Claims, 4 Drawing Sheets

HEATING ROLLER ASSEMBLY FOR ELECTROPHOTOGRAPHIC PRINTER AND METHOD OF MAKING THE SAME

CLAIM OF PRIORITY

This application makes reference to, incorporates the same herein, and claims all benefits accruing under 35 U.S.C. §119 from an application for HEATING ROLLER ASSEMBLY FOR ELECTROPHOTOGRAPHIC PRINTER earlier filed in the Korean Industrial Property Office on Feb. 22, 2001 and there duly assigned Ser. No. 9038/2001 by that Office.

BACKGROUND OF THE INVENTION

1. Field of the Invention

The present invention relates to a heating roller assembly in an electrophotographic printer for fixing a toner or developed image on a printing medium, and more particularly, to a direct-heating type heating roller assembly including a power connecting member mounted on both a heating layer and a protective layer.

2. Description of the Related Art

Printers have been provided with a direct-heating type fixing roller assembly for fixing a toner image or a developed image on a printing medium. The direct heating type fixing roller assembly defines a roller body and a current resistance heating layer formed around a cylindrical circumferential outer surface of the roller body. Typically, a pair of electrically conductive power connecting members having a hollow ring shape and coupled to a terminal of an external power source are inserted around the roller body and connected to the current resistance heating layer to supply power to the heating layer and to heat the heating roller assembly to a predetermined high temperature for fixing the image on the printing medium.

The power connecting member, however, becomes damaged due to the mechanical pressure applied to the fixing roller when the power connecting member is heated to the high temperature from a room temperature in a very short period of time for quick-heating and fixing the printing image on the printing medium during the operation of the printer. The damaged power connecting member causes an electrical disconnection between the heating layer and the power connecting member.

Moreover, due to the repeatedly exerted thermal shock and electrical shock, a great extent of stress is exerted on the power connecting member. Thus, durability of the power connecting member becomes deteriorated as cracks are developed in the power connecting member and the heating layer. Furthermore, it is not safe but dangerous when sparks are generated in the cracks of the damaged power connecting members and the heating layer.

SUMMARY OF THE INVENTION

To solve these and other problems in the art, it is an object of the present invention to provide an improved heating roller assembly.

It is another object to provide an improved power connecting member mounted on a roller body of a heating roller assembly.

It is still another object to provide a heating roller assembly able to prevent a power connecting member from being damaged due to mechanical shock exerted on the power connecting member.

It is yet another object to provide a heating roller assembly able to reduce thermal shock applied to a power connecting member mounted on the heating roller assembly.

It is still yet another object to provide a heating roller assembly able to prevent a electrical disconnection between a heating roller and a power connecting member.

It is also an object to provide a heating roller assembly able to improve durability and stability of the electric contact between a power connecting member and a heating layer generating heat for fusing and fixing a toner image on a printing medium.

To achieve these and other objects of the present invention, there is provided a heating roller assembly including a roller body and at least one power connecting member mounted around the roller body. The roller body includes a cylindrical body having an axial axis, a protective layer deposited on a circumferential outer surface of the cylindrical body, and a heating layer disposed between the cylindrical body and the protective layer and having terminal portions formed on each end of the heating layer. An inner protective layer is disposed between the heating layer and the cylindrical body.

The power connecting member is disposed around the terminal portion of the heating layer to be put in contact with the terminal portion of the heating layer, thereby supplying power to the heating layer. The heating roller assembly includes a stress distribution means formed on a circumferential inner surface of the power connecting member for dispersing thermal or mechanical stress exerted on the power connecting member during rotation of the heating roller assembly or during heating the heating layer.

The stress distribution means includes a plurality of elevated surfaces formed on a cylindrical circumferential inner surface of the power connecting member facing the roller body. Each elevated surface of the stress distribution means has a radial distance from the axial axis of the cylindrical body and is formed along the cylindrical circumferential inner surface in a circular direction. The radial distances of the elevated surfaces are different from each other. The elevated structure of the stress distribution means corresponds to an elevated structure of the heating layer and the protective layer.

The outer protective layer has a length in the axial direction less than the heating layer so that an end portion of the outer protective layer does not cover the terminal portion of the heating layer. The end portion of the protective layer and the terminal portion of the heating layer are surrounded by respective elevated surfaces of the stress distribution means of the power connecting member. A first elevated surface of the stress distribution means surrounds the cylindrical outer surface of the terminal portion of the heating layer while a second elevated surface of the stress distribution means surrounds a cylindrical outer surface of the end portion of the protective layer. Since a thickness of the power connecting member in the axial direction of the cylindrical body is greater than the terminal portion of the heating layer, the power connecting member surrounds the end portion of the protective layer. A vertical side formed between the first and second elevated surfaces of the stress distribution means is disposed to face a distal end surface of the protective layer. A bonding layer made of a conductive material is disposed between the elevated surfaces of the power connecting member and the terminal portion of the heating layer or the end portion of the protective layer.

In a second embodiment, it is preferred that the protective layer includes an outer insulating layer disposed on the heating layer, an adhesive layer disposed on the outer insulating layer, and a coating layer disposed on the adhesive layer. An end portion of the outer insulating layer is covered by the second elevated surface of the stress distribution means. The bonding layer made of the conductive material is disposed between the first elevated surfaces of the stress distribution means and the terminal portion of the heating layer and between the second elevated surface and the end portion of the outer insulating layer of the protective layer.

In a third embodiment, it is preferred that the outer insulating layer, the adhesive layer, and the coating layer of the protective layer have the same length in the axial direction. The length of the protective layer is less than the heating layer. While the first elevated surface of the stress distribution means covers the terminal portion of the heating layer, the second elevated surface of the stress distribution means of the power connecting member surrounds the end portion of the coating layer which forms an outer circumferential surface of the roller body. The distal end surfaces of the outer insulating layer, the adhesive layer, and the coating layer of the protective layer are surrounded by the vertical side of the stress distribution means of the power connecting member. The bonding layer made of the conductive material is disposed between the elevated surfaces of the stress distribution means and each one of the terminal portion of the heating layer, the end portions of the coating layer, the outer insulating layer, the distal ends surfaces of the protective layer. Furthermore, it is preferred that the heating layer includes a plurality of heating layers which are sequentially disposed around the cylindrical body, and that terminal portions of the heating layers are surrounded by each one of a pair of the first elevated surfaces of the stress distribution means.

In a fourth embodiment, it is preferred that the stress distribution means has an inclined inner surface having an angle with respect to the cylindrical circumferential outer surface of the cylindrical body. The stress distribution means is line-contact with an edge portion of the heating layer while a conductive bonding material is filled between the inclined inner surface of the power connecting member and the terminal portion of the heating layer and the end portion of the protective layer except the portion of the line contact formed between the slant inner surface of the power connecting member and the edge portion of the heating layer.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
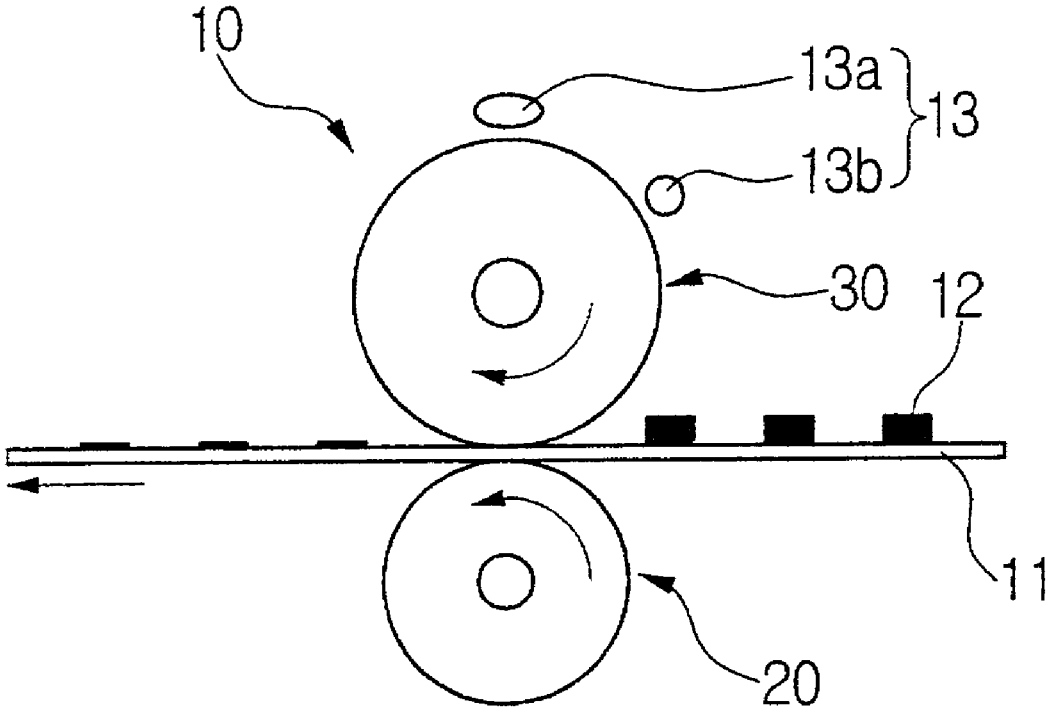
FIG. 1 is a schematic cross-sectional view illustrating an electrophotographic printer.

Turning now to the drawings, FIG. 1 shows a fixing unit 10 of an electrophotographic printer. Fixing unit 10 includes a heating roller 30 and a backup roller 20. A printing medium 11 having a developer 12 formed by a developing unit (not shown) passes between heating roller 30 and backup roller 20. Heating roller 30 functions to press and heat developer 12 and printing medium 11, thereby fixing developer 12 on print medium 11.

A reference numeral 13 denotes a temperature sensing means for sensing a temperature on a circumferential outer surface of heating roller 30. Temperature sensing means 13 includes at least one thermistor which is arranged on the circumferential outer surface of heating roller 30. Generally, heating rollers are divided into an indirect heating type heating roller and a direct heating type heating roller. Heating roller 30 can be used not only in the above-described fixing unit 10 but also in a different type of fixing roller for heating and pressing a toner image or a developer and a printing medium.

Figure 2:
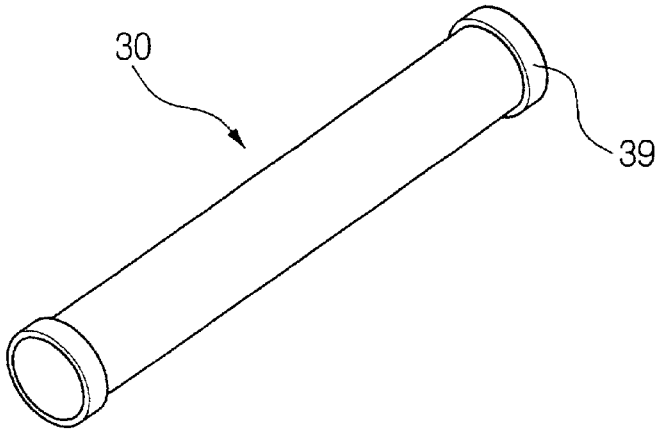
FIG. 2 is a perspective view illustrating a direct heating type heating roller.
Figure 3:
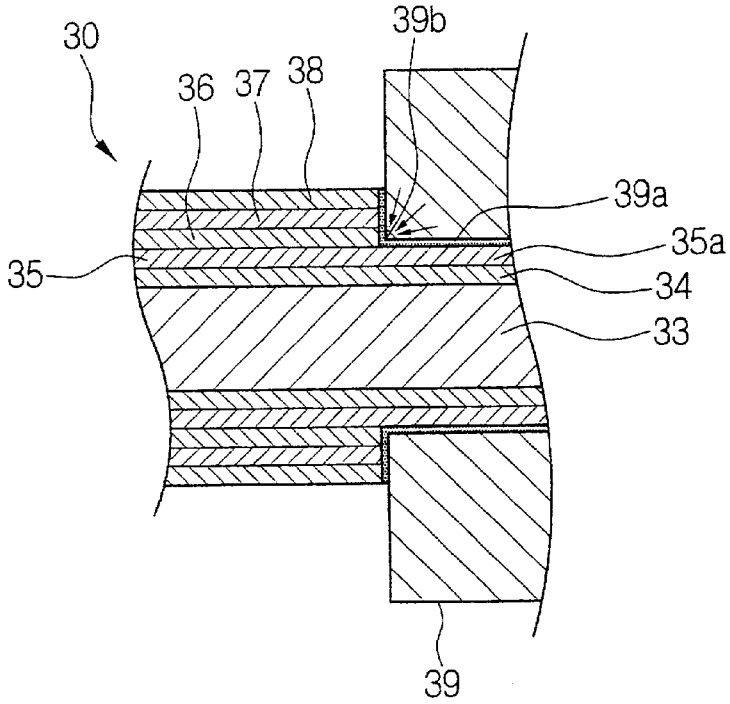
FIG. 3 is a partially enlarged cross-sectional view illustrating a main part of the direct heating type heating roller.

Referring to FIGS. 2 and 3, there is illustrated a direct heating type heating roller 30. A heating layer 35 made of a current resistance material is directly disposed around deposited on a cylindrical circumferential outer surface of an inner insulating layer 34 of a cylindrical body 33. Also, a pair of power connecting members 39 each having a ring-shaped structure are respectively inserted around and coupled to respective terminal portion 35*a* of heating layer 35 so that electric power is supplied to heating layer 35 through power connecting member 39 which is connected to an external power source. Because heating layer 35 is made of the current resistance material, the temperature of heating roller 30 rises by the heat generated from heating layer 35 in response to the transmitted electric power.

Compared to the indirect heating type heating roller which needs an external heating device, such as a heating lamp or the like, the direct heating type heating roller 30 renders merits in that, due to its simple construction, it can be manufactured in a simplified manner, that productivity is enhanced, and that durability is improved.

Referring to FIG. 3, direct heating type heating roller 30 has an inner insulating layer 34, heating layer 35, and a protective layer which are sequentially disposed around a cylindrical circumferential outer surface of cylindrical body 33. The protective layer includes an outer insulating layer 36, an adhesive layer 37, and a coating layer 38. Heating layer 35 has terminal portions 35*a* at both ends thereof. Terminal portions 35*a* are exposed to the outside of heating roller 30 in a radial direction of cylindrical body 33 because the protective layer does not cover the terminal portion 35*a* of heating layer 35. Power connecting members 39 each having a ring-shaped structure are inserted around and coupled to the exposed terminal portion 35*a* using a bonding layer 39*a* disposed between an inner surface of power connecting member 39 and terminal portion 35*a* of heating layer 35. Since bonding layer 39*a* is made of a conductive material, the electric power is transmitted to heating layer 35 from the external power source via power connecting member 39.

When heating layer 35 is repeatedly heated to a high temperature from room temperature in a very short period of time by the direct contact between power connecting member 39 and heating layer 35, a thermal shock is exerted to power connecting member 39. Moreover, when heating roller 30 rotates and is pressed against the printing medium 11 for fixing operation of the heating roller, a mechanical shock is exerted to power connecting member 39. Due to the thermal and electrical shock, a great amount of stress are generated in power connecting member 39. The stress exerted on an edge portion 39*b* of power connecting member 39 is indicated as arrows in FIG. 3.

Figure 4:
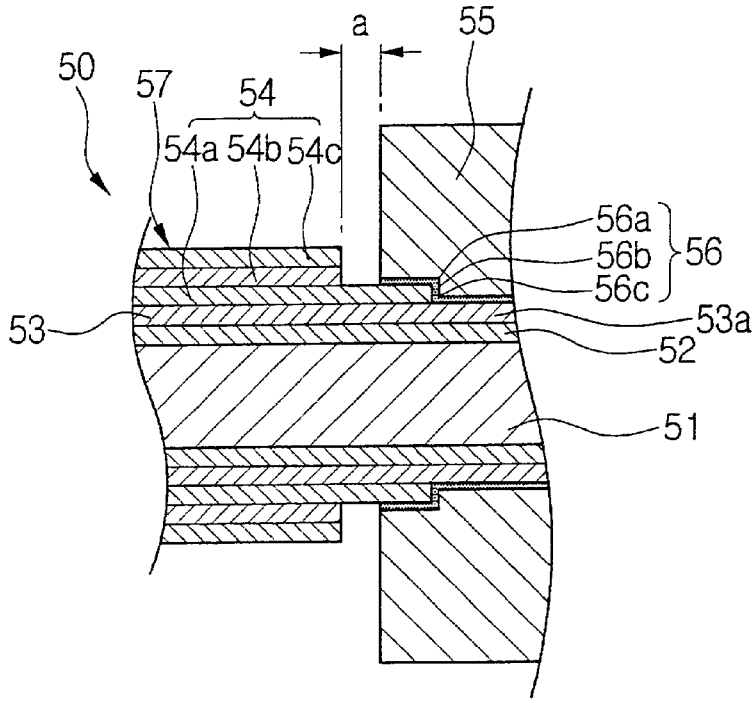
FIG. 4 is a partial cross-sectional view illustrating a heating roller assembly constructed according to a first embodiment of the present invention.

In FIG. 4, a heating roller assembly 50 for an electrophotographic printer includes a roller 57, a power connecting member 55 for supplying the electric power to heating roller 57, and stress distribution means for distribute and disperse the stress exerted on power connecting member 55 during driving heating roller assembly 50.

Heating roller 57 includes a cylindrical body 51 having an axial axis, and an inner insulating layer 52, a heating layer 53 and a protective layer 54 which are sequentially deposited on a circumferential outer surface of cylindrical body 51.

Cylindrical body 51 is formed at both ends thereof with rotation shaft portions (not shown) so that it can be rotatably driven by an external driving section (not shown). It is preferred that cylindrical body 51 be made of high-strength aluminum alloy.

Inner insulating layer 52 is disposed between heating layer 53 and cylindrical body 51 and functions to insulate heating layer 53 and to prevent heat transfer from heating layer 53 to cylindrical body 51.

Heating layer 53 is disposed on a circumferential outer surface of inner insulating layer 52. A current resistive heating element forming heating layer 53 generates the heat to increase the temperature of heating roller 57 when the electric power is applied to the heating layer.

At least one terminal portion 53*a* for receiving the electric power from power connecting member 55 is defined at heating layer 53 in a manner such that it is exposed to an outside of heating roller 57. According to the present invention, both ends of heating layer 53 serve as terminal portions 53*a* which is integrally made of the same material as heating layer 53.

Protective layer 54 is disposed on a circumferential outer surface of heating layer 53. Generally, protective layer 54 includes an outer insulating layer 54*a*, an adhesive layer 54*b*, and a coating layer 54*c* all formed on the circumferential cylindrical outer surface of heating layer 53. Protective layer 54 does not cover the terminal portions 53*a* of heating layer 53. A longitudinal length of protective layer 54 in an axial direction of cylindrical body 51 is less than the heating layer 53 by a length of terminal portions 53*a* of heating layer 53.

Outer insulating layer 54*a* is disposed on heating layer 53 and can be made of the same material as inner insulating layer 52 so that both outer insulating layer 54*a* and inner insulating layer 52 insulate heating layer 53 while the heat generated from heating layer 53 is transmitted to coating layer 54*c* through outer insulating layer 54*a*.

Coating layer 54*c* is put into direct contact with a printing medium (not shown) which is pressed and heated by heating roller assembly 50. It is preferred that coating layer 54*c* be made of material having a soft surface, such as rubber material, synthetic resin, or the like. For example, in the case of a heating roller assembly which is employed in a liquid electrophotographic printer, coating layer 54*c* can be made of synthetic resin, such as sponge or the like, to easily absorb a liquid carrier which is contained in a developer.

Adhesive layer 54*b* is also referred to as a primer layer. Adhesive layer 54*b* is deposited between outer insulating layer 54*a* and coating layer 54*c* for easy coupling of coating layer 54*c* with outer insulating layer 54*a*.

Power connecting member 55 is inserted around the end portion of outer insulating layer 54*a* and terminal portion 53 of heating layer 53. Each inside surface of power connecting member 55 is brought into direct contact with terminal portion 53*a* of heating layer 53 thereby to apply the electric power to heating layer 53. Generally, power connecting member 55 has a ring-shaped configuration. Both ends of heating roller 57 are inserted into and fitted into power connecting members 55.

In a method of coupling power connecting members 55 to roller 57, a pair of power connecting members 55 are heated to have an inner diameter enlarged, and then both ends of heating roller 57 are respectively inserted into each inside hole of power connecting members 55. After power connecting members 55 are inserted around heating roller 57, power connecting members 55 are cooled to shrink, and then roller 57 and power connecting members 55 are fixedly coupled to each other.

Here, a length of each power connecting member 55 brought into contact with each terminal portion 53*a* is determined depending upon a printing medium and a size of a printer. Preferably, the length is set to 1 mm.

A circumferential inner surface of power connecting member 55 is coupled to a portion of heating roller 57 facing the circumferential inner surface of power connecting member 55 after a bonding layer 58 applied to a portion of heating roller 57 facing circumferential inner surface of power connecting member 55. It is preferred that a conductive bonding material is used for bonding layer 58 to allow the electrical power to be transmitted from power connecting member 55 to terminal portion 53*a* of heating layer 53. More preferably, silver paste is used for the conductive bonding material.

Also, an outside portion of power connecting member 55 is put to be sliding contact with an external power supplying device (not shown) to receive the electrical power during rotatably driving heating roller assembly 50.

The stress distribution means includes an elevated section 56 formed on the circumferential inner surface of power connecting member 55 being contact with terminal portion 53*a* in a manner such that elevated section 56 surrounds both the end portion of protective layer 54 and terminal portion 53*a* of heating layer 53.

Elevated section 56 includes a first elevated surface and a second elevated surface both formed on the circumferential inner surface of power connecting member and both covering cylindrical outer surfaces of terminal portion 53*a* of heating layer 53 and the end portion of outer insulating layer 54*a* of protecting layer 54, respectively. A first edge portion 56*a*, a vertical surface portion 56*b* and a second edge portion 56*c* are formed in succession on the circumferential inner surface of power connecting member 55 between the first elevated surface and the second elevated surface of the circumferential inner surface of power connecting member 55. Accordingly, the end portion of outer insulating layer 54*a* is inserted into and thereby coupled to the second elevated surface of elevated section 56 of power connecting member 55 while adhesive layer 54*b* and coating layer 54*c* are spaced-apart from power connecting member 55.

A height of vertical surface portion 56*b* is approximately the same as a thickness of outer insulating layer 54*a*. Adhesive layer 54*b* and coating layer 54*c* is sequentially disposed on outer insulating layer 54*a* in a manner such that each end of adhesive layer 54*b* and coating layer 54*c* is spaced-apart from a side surface of power connecting member 55 by a predetermined distance "a" in order not to cause electrical shock which may be otherwise induced due to electrical contact between power connecting member 55 and adhesive layer 54*b* or coating layer 54*c* when the power is supplied to power connecting member 55 from the external power source.

In heating roller assembly 50 constructed as mentioned above, the load-induced stress exerted on power connecting member 55 can be effectively dispersed to first and second edge portions 56*a* and 56*c*, to the first elevated surface and the second elevated surface, or to vertical surface portion 56*b*.

Furthermore, a rough surface having a predetermined surface roughness is formed on the circumferential inner surface of power connecting member 55. The rough surface is formed on any one of first edge portions 56*a*, second edge portions 56*c*, the first elevated surface, the second elevated surface, and vertical surface portion 56*b*. A magnitude of the roughness of the rough surface strengthens the coupling between heating roller 57 and power connecting member 55 and improves the dispersion or distribution of the stress exerted on power connecting member 55.

When the roughness of the power connecting member 55 increases, the coupling between heating roller 57 and power connecting member 55 is strengthened, and the dispersion or distribution of the stress exerted on power connecting member 55 is more effective. It is appropriated that the roughness of the power connecting member 55 be set to a magnitude of 4±2 mm.

Also, a person skilled in the art will readily recognizes that elevated section 56 can be formed to have a variety of figures, such as a curved surface or a saw surface, etc., which are formed on the circumferential inner surface of power connecting member 55 which is put into contact with terminal portion 53*a* of heating layer 53 and the end portion of protective layer 54. Elevated section 56 having a plurality of elevated surfaces formed in a circular direction on the circumferential inner surface of the inner hole of power connecting member 55 and arranged in an axial direction in series is gradually increased in its diameter in a radially outward direction of the inner hole of power connecting member 55 and in the axial direction of cylindrical body 51. Since the circumferential inner surface of power connecting member 55 is formed to have the curved surface as described above, the dispersion of the stress exerted on power connecting member 55 is improved.

Figure 5:
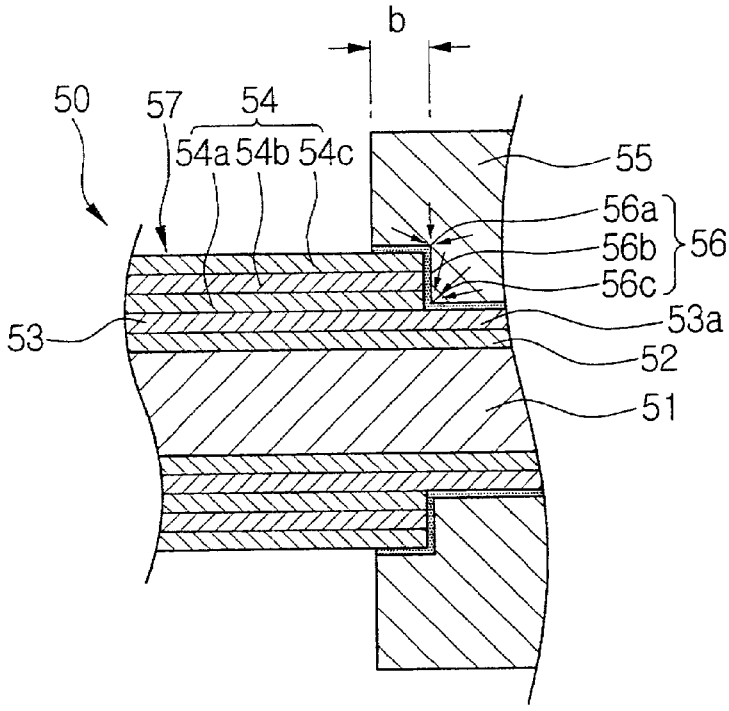
FIG. 5 is a partial cross-sectional view illustrating a second embodiment of a heating roller assembly.

FIG. 5 shown a second embodiment of a heating roller assembly constructed in accordance with principles of the present invention. In heating roller assembly 50, an inner insulating layer 52 and a heating layer 53 are sequentially disposed around the circumferential cylindrical outer surface of cylindrical body 51. A pair of power connecting members 55 are heated to have the inner diameter enlarged and are inserted around terminal portion 53*a* of heating layer 53 and the end portion of protective layer 54. Elevated section 56 formed on a circumferential inner surface of each power connecting member 55 and including a vertical surface portion 56*b*, a plurality of edge portions 56*a* and 56*c*, and the first and second elevated surfaces is disposed to face the distal surface of protective layer 54, terminal portion 53*a* of heating layer 53, and the cylindrical outer surface of the end portion of coating layer 54*c* of protective layer 54, respectively. Both the end portion of protective layer 54 and terminal portion 53*a* of heating layer 53 are inserted into the enlarged inner hole of power connecting member 55. Preferably, a height of vertical surface portion 56*b* of power connecting member 55 is approximately the same as a thickness of protective layer 54 including outer insulating layer 54*a*, adhesive layer 54*b*, and coating layer 54*c*.

The second elevated surface of elevated section 56 of power connecting member 55 is disposed to cover an end portion of a circumferential cylindrical outer surface of coating layer 54*c* of protective layer 54 by a predetermined length "b". It is preferred that a contact area between the second elevated surface of elevated section 56 of power connecting member 55 and the end portion of protective layer 54 be smaller than the contact area between the first elevated surface of elevated section 56 of power connecting member 55 and terminal portion 53*a* of heating layer 53.

With heating roller assembly 50 constructed as mentioned above, the stress exerted on heating roller assembly 50 and a portion of power connecting member 55 can be dispersed and distributed to first and second edge portions 56*a* and 56*c* as shown in FIG. 5 by arrows, vertical portion 56*c*, or the first and second elevated surfaces of elevated section 56 of power connecting member 55.

When the length "b" increases, the stress is dispersed more effectively through the stress distribution means. Also, due to the length "b" of both ends of protective layer 54 surrounded by power connecting members 55, protective layer 54 and heating layer 53 are prevented from being detached from each other during heating and driving heating roller assembly 50.

Figure 6:
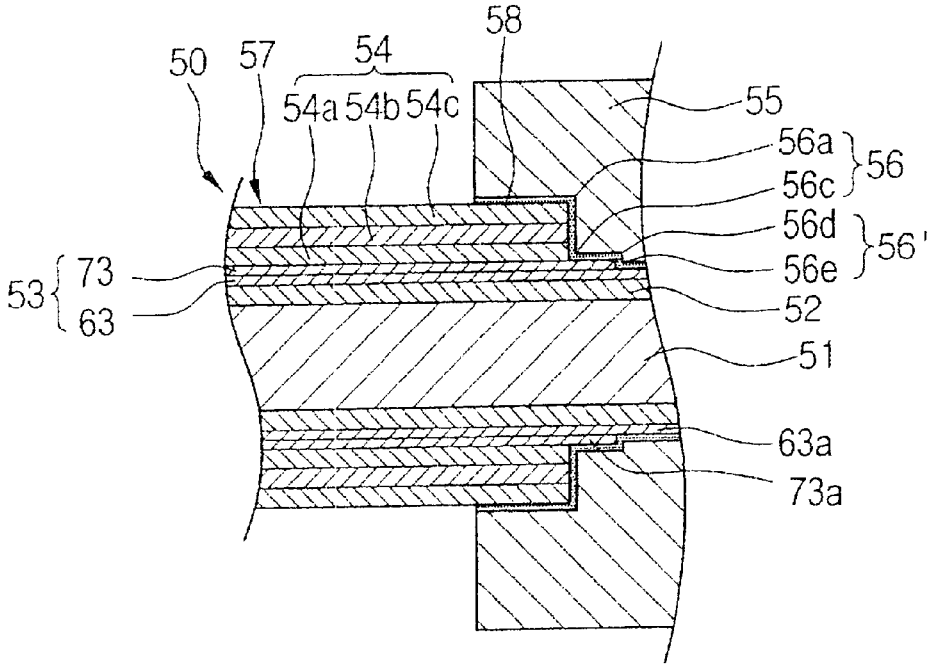
FIG. 6 is a partial cross-sectional view illustrating of a third embodiment of a heating roller assembly.

FIG. 6 shows a third embodiment of a heating roller assembly 50 construction according to the principles of the present invention. In heating roller assembly 50, an inner insulating layer 52 is disposed on a cylindrical body 51, and a heating layer 53 is deposited on a circumferential outer surface of inner insulating layer 52.

Heating layer 53 includes an inner heating layer 63 and an outer heating layer 73 which are formed in a manner such that inner and outer heating layers are sequentially disposed on the circumferential outer surface of the inner insulating layer 52 to disperse the stress exerted on heating layer 53 and power connecting member 55 more efficiently during driving heating roller assembly 50. Terminal portions 63*a* and 73*a* are formed on both ends of heating layers 63 and 73 to contact power connecting member 55. As readily seen from FIG. 6, a length of terminal portion 63*a* of inner heating layer 63 is smaller than terminal portion 73*a* of outer heating layer 73.

Moreover, elevated sections 56 and 56' are formed on a circumferential inner surface of power connecting member 55 and disposed to respectively correspond to terminal portions 63*a* and 73*a* and protective layer 54. Four edge portions 56*a*, 56*b*, 56*d*, and 56*e* are formed on the circumferential inner surface of power connecting member 55. The second elevated surface of the elevated section of power connecting member 55 covers the circumferential outer surface of coating layer 54*c* of protective layer 54. The first elevated surface of the elevated section covers terminal portion 63*a* of inner heating layer 63 while a third elevated surface formed between the first and second elevated surfaces and formed between edge portions 56*c*, 56*d* covers terminal portion 73*a* of outer heating layer 73. A vertical portion of the elevated section formed between edge portions 56*d*, 56*e* is disposed to face an distal end surface of terminal portion 73*a* of outer heating layer 73 and has the same thickness as outer heating layer 73 while a second vertical portion of the elevated section is disposed to face distal end surfaces of outer insulation layer 54*a*, adhesive layer 54*b*, and coating layer 54*c* of protective layer 54.

When heating roller assembly 50 is driven, the stress exerted on heating layer 53 is dispersed into inner and outer heating layers 63, 73 of heating layer 53. Also, the stress exerted on power connecting member 55 is dispersed into respective edge portions 56*a*, 56*b*, 56*d*, and 56*e*, the elevated surfaces, or the vertical portions.

In the above-described embodiment, elevated section 56 formed on the circumferential inner surface of power connecting member 55 may have a variety of numbers and figures. As the number of edge portions increases, the stress can be more effectively dispersed to respective edge portions, the elevated surfaces, or the vertical portions of power connecting member 55.

Furthermore, when the respective edge portions are rounded, the strength of power connecting member 55 against the loaded stress effectively increases because the stress is exerted on the edge portions.

Figure 7:
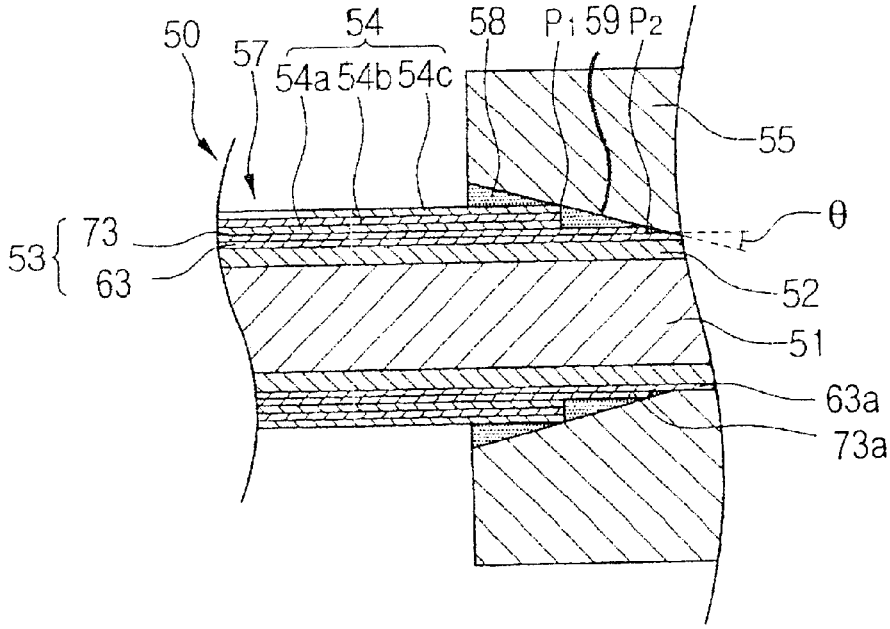
FIG. 7 is a partial cross-sectional view illustrating a fourth embodiment of a heating roller assembly.

FIG. 7 is a fourth embodiment of a heating roller assembly constructed in accordance with the principles of the present invention. In heating roller assembly 50, protective layer 54 and heating layer 53 are the same structure as the third embodiment shown in FIG. 6.

The stress distribution means formed on a circumferential inner surface of power connecting member 55 is an inclined cylindrical inner surface 59 with respect to a cylindrical surface parallel to the axis of cylindrical body 51. Inclined surface 59 of the circumferential inner surface of power connecting member 55 is brought into line-contact with protective layer 54 and heating layer 53 as indicated P1 and P2 and at the same time is brought into surface-contact with terminal portion 63*a* of inner heating layer 63.

Power connecting member 55 contacts terminal portions 63*a* and 73*a* of heating layer 53, since inclined surface 59 of power connecting member 55 is disposed around the end portion of protective layer 54 and terminal portions 63*a* and 73*a* of inner and outer heating layer 63, 73 of heating layer 53. At this time, inclined surface 59 of the circumferential inner surface of power connecting member 55 has a predetermined inclination angle θ with respect to a rotation axis of cylindrical body 51.

Protective layer 54 and heating layer 53 having a thickness in the range between 10 mm and 100 mm are regarded as a small thickness compared to power connecting member 55. A space between inclined surface 59 and the end portion of protective layer 54 and terminal portion 63*a*, 73*a* of heating layer is filled with a conductive material as a bonding layer 58. The circumferential outer surface of bonding layer 58 is similar to an outer surface of a frustum of a cone while inclined surface 59 of power connecting member 55 corresponds to the circumferential outer surface of bonding layer 58.

Contact portions P1 and P2 are formed between power connecting member 55 and protective layer 54 and can be an annular line-contact along the inclined surface of the circumferential inner surface of power connecting member 55 since heating roller 57 and power connecting member 55 are respectively formed to have a circular or cylindrical structure.

In heating roller assembly 50, the stress exerted on a portion of power connecting member 55 can be dispersed to the contact point portions P1 and P2, and the stress exerted on heating layer 53 can be dispersed to the plurality of heating layers 63 and 73 or protective layer 54.

On the other hand, each of protective layer 54 and heating layer 53 may include a plurality of layers which are sequentially disposed on cylindrical body 51 in various ways to define one or more elevated structure having a plurality of elevated surfaces. The circumferential inner surface of power connecting member 55 can be formed to define one or more elevated surfaces corresponding to the elevated structure of protective layer 54 and heating layer 53.

Furthermore, one or more contact point portions P1 and P2 can be defined in conformity with the one or more elevated structures of protective layer 54 and heating layer 53. Consequently, the stress exerted on power connecting member 55 during driving heating roller assembly 50 can be dispersed in a diversity of ways by the stress dispersing means.

As described above, the direct heating type heating roller assembly for an electrophotographic printer constructed according to the principles of the present invention, provides advantages in that the stress generated due to frequent temperature change and electrical shock in such a way as to be concentrated to a portion of the power connecting member 55, can be effectively dispersed because an inner configuration of the power connecting member for applying electric power to the heating layer is modified to have one or more elevated structure or an inclined surface which are suitable to disperse the stress into the elevated structure or the inclined surface of the power connecting member.

Thus, durability of the power connecting member is improved. Also, stability of the heating roller assembly is improved since it is possible to avoid electrical exposure caused by the spark or the like due to a crack developed in the power connecting member.

Moreover, because the level of the allowable strength against the stress exerted on the power connecting member employed in the heating roller assembly becomes lowered, the power connecting member can be manufactured using a material with a low strength, whereby the manufacturing cost for the heating roller assembly is reduced.

Furthermore, as the power connecting member is formed in a manner such that it surrounds both ends of the protective layer and heating layer, it is possible to prevent the protective layer from being detached from the heating layer during rotatably driving the heating roller assembly. As a consequence, operational reliability is considerably improved.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A heating roller assembly for a printer having a roller body and a power connecting member inserted around said roller body, comprising:

said roller body including a cylindrical body, a heating layer formed on a circumferential outer surface of said cylindrical body, and a protective layer formed on a circumferential outer surface of said heating layer, said protective layer covering said heating layer except a terminal portion of said heating layer;

said power connecting member inserted around said roller body, having an inner surface covering cylindrical outer surfaces of both said terminal portion of said heating layer and an end portion of said protective layer.

2. The heating roller assembly of claim 1, said inner surface of said power connecting member comprising a stepped section having a first step surface and a second step surface, said first step surface covering said terminal portion of said heating layer while said second step surface covers said end portion of said protective layer.

3. The heating roller assembly of claim 2, with said protective layer including an outer insulating layer, an end portion of which is surrounded by said second stepped surface of said stepped section, a coating layer formed on a circumferential outer surface of said outer insulating layer, and an adhesive layer disposed between said outer insulating layer and said coating layer.

4. The heating roller assembly of claim 3, wherein said coating layer and said adhesive layer are spaced-apart from said power connecting member by a predetermined distance while said outer insulating layer is covered by said second stepped surface.

5. The heating roller assembly of claim 2, with said protective layer comprising an outer insulating layer, an adhesive layer, and a coating layer, each end of said outer insulating layer, said adhesive layer, and said coating layer of said protective layer surrounded by said second stepped surface of said power connecting member.

6. The heating roller assembly of claim 2, said heating layer comprising inner and outer heating layers sequentially formed on said cylindrical body, each terminal portion of said inner and outer layers having a stepped structure formed at ends of said inner and outer heating layers and covered by said first stepped surface of said power connecting member.

7. The heating roller assembly of claim 6, with said first stepped surface including an inner stepped surface and an outer stepped surface corresponding to said stepped structure of said ends of said inner and outer heating layers.

8. The heating roller assembly of claim 1, with said inner surface of said power connecting member being a slant surface with respect to a cylindrical surface of said cylindrical body, said slant surface contacting both a distal end of protective layer and a distal end of said heating layer.

9. The heating roller assembly of claim 1, said heating layer comprising an inner heating layer and an outer heating layer both forming a stepped structure, said inner heating layer having an inner terminal portion contacting said inner surface of said power connecting member, said outer heating layer having a distal end contacting said inner surface of said power connecting member.

10. The heating roller assembly of claim 1, said inner surface of said power connecting member being a rough surface having a predetermined roughness.

11. The heating roller assembly of claim 1, further comprising a conductive bonding layer disposed between said inner surface of said power connecting member and said terminal portion of said heating layer.

12. The heating roller assembly of claim 1, further comprising a conductive bonding layer disposed between said inner surface of said power connecting member and said end portion of said protective layer.

13. The heating roller assembly of claim 1, further comprising a conductive bonding layer disposed between said inner surface of said power connecting member and said terminal portion of said heating layer and said end portion of said protective layer.

14. A heating roller assembly for a printer, comprising:

a roller body including a cylindrical body, a heating layer formed on a circumferential outer surface of said cylindrical body, a protective layer formed on a circumferential outer surface of said heating layer, and an inner insulating layer formed between said cylindrical body and said heating layer, said protective layer covering said heating layer except at a terminal portion of said heating layer; and a power connecting member inserted around said roller body, having an inner surface covering both said terminal portion of said heating layer and an end portion of said protective layer adjacent to said terminal portion of said heating layer.

15. The heating roller assembly of claim 14, said inner surface of said power connecting member comprising a stepped section having a first step surface and a second step surface, said first step surface electrically and physically contacting said terminal portion of said heating layer while said second step surface contacts said end portion of said protective layer, said heating layer being resistive and heats up significantly upon application of a current.

16. The heating roller assembly of claim 15, with said first stepped surface and said second stepped surface both forming a stepped structure that mates with an outer surface of said terminal portion of said heating layer and said end portion of said protective layer, said inner surface of said power connecting member corresponding to said stepped structure.

17. The heating roller assembly of claim 15, said first and second step surfaces being cylindrical in shape, said second step surface having a slightly larger radius of curvature than said first step surface.

18. The heating roller assembly of claim 14, with said inner surface of said power connecting member being a slant surface with respect to a cylindrical surface of said cylindrical body, said slant surface surrounding both a distal end of protective layer and a distal end of said heating layer.

19. A process for making a heating roller assembly used in a printer, comprising the steps of:

providing a cylindrical body;

forming an inner insulating layer on a circumferential outer surface of said cylindrical body;

forming a heating layer on a circumferential outer surface of said inner insulating layer, said heating layer having a terminal portion;

forming a protective layer on a circumferential outer surface of said heating layer, said protective layer surrounding said heating layer at all portions of said heating layer except at terminal end portions of said heating layer, said protective layer having an end portion parallel to said cylindrical body;

providing a power connecting member having a cylindrical ring shape and an inner surface; and inserting said power connecting member around both said terminal portion of said heating layer and said end portion of said protective layer, said inner surface of said power connecting member surrounding said terminal portion of said heating layer and said end portion of said protective layer.

20. The process of claim 19, further comprising the step of providing said inner surface of said power connecting member with one of a stepped structure and an inclined surface inclined with respect to a cylindrical surface of said cylindrical body.

21. A heating roller assembly for a printer, comprising:

a cylindrical body, a resistive heating layer formed on a circumferential outer surface of said cylindrical body, and a protective layer formed on a circumferential outer surface of said heating layer, said protective layer covering said heating layer except at terminal end portions of said heating layer;

a pair of power connecting members, each being inserted at respective ends of said heating roller, said power connecting member having an inner surface covering and contacting said cylindrical outer surface of said terminal portions of said heating layer.

22. The heating roller of claim 21, said power connecting members being spaced apart from ends of said protective layer and not being in contact with said protective layer.

23. The heating roller of claim 21, said inner surface of said power connecting members being also in contact with end portions of said protective layer, said inner surface of said power connecting members having a profile that mates with a step profile of said ends of said protective layer and said exposed terminal ends of said resistive heating layer.

* * * * *